United States Patent [19]

Larime

[11] 4,136,337

[45] Jan. 23, 1979

[54] BUZZER ASSEMBLY

[75] Inventor: Carl M. Larime, Fairfield, Conn.

[73] Assignee: General Signal Corporation, Rochester, N.Y.

[21] Appl. No.: 846,099

[22] Filed: Oct. 27, 1977

[51] Int. Cl.[2] ..... G08B 3/00

[52] U.S. Cl. ..... 340/384 R; 340/402

[58] Field of Search ..... 340/384 R, 402; 336/607; 29/602 R

[56] References Cited

U.S. PATENT DOCUMENTS 4,005,413 1/1977 Berns ..... 340/402

*Primary Examiner*—Harold I. Pitts

*Attorney, Agent, or Firm*—Milton E. Kleinman; George W. Killian

[57] ABSTRACT

An improved buzzer structure is designed for automated assembly and comprises a housing, a coil wound on a bobbin, a magnetic frame, and an armature mounted for reciprocating movement between a coil core and a diaphragm. The magnetic frame includes parallel side members which mate with parallel edges of the bobbin flange for guiding and orienting the bobbin as it is inserted in the preformed frame. The frame also includes parallel top and bottom members separated by an amount slightly in excess of the bobbin height so as not to restrict bobbin insertion. The bobbin has a coupled coil terminal which mates with an arch on the frame for providing an electrical connection therebetween. An area of light pressure contact between the bobbin and frame, and starting at an intermediate point of bobbin insertion, is provided for maintaining a fixed relationship between the bobbin and the frame after the bobbin has been inserted to a predetermined relationship with respect to the frame. Retaining the predetermined relationship permits movement of the subassembly comprising the frame and bobbin to a subsequent assembly station for further assembly operations.

16 Claims, 15 Drawing Figures

BUZZER ASSEMBLY

BACKGROUND OF THE INVENTION

Audible alarms, buzzers, bells, chimes, and signaling devices come in a wide variety of forms to serve a wide range of applications. Some devices are produced to provide a maximum sound output, others are designed for maximum durability, some are designed to produce a tone within a particular frequency range, some are intended to withstand the rigors of a hostile environment, and some are designed to produce a muted or pleasant tone. Many other design criteria are used, and, frequently, size is an important consideration as is also economy and the type of power available for operation. The buzzer of the present invention is designed for a.c. or d.c. use and, as is understood by those famiilar with such devices, a substitution of one coil for another, and/or minor mechanical adjustments, will permit use with a.c. or d.c. potential sources with a wide range of input potential. The buzzer disclosed herein is designed for maximum economy in manufacture and is small, but not of microminiature size. While the buzzer is designed to produce a significant sound, it is not designed for a maximum ratio of sound output to power input, nor to produce a signal of any specific and controlled frequency.

Buzzers which have some construction characteristics in common with the buzzer disclosed herein are shown in U.S. Pat. No. 3,864,823 and 3,931,549, both issued to Charles Berns and assigned to the same assignee as the present invention.

In years past, devices of this general nature were fabricated using considerable hand labor. However, the cost of labor has become so significant that it is frequently economical to design devices for automated assembly, using intricate and costly assembly machines to replace human labor. The buzzer of the present invention is designed to permit automated assembly in moderate quantities.

One problem which arises, with respect to automated assemblies, is that frequently two parts must be assembled with a specific relative orientation in order to admit the placement of a third part. Frequently, the subassembly of the two parts must be moved from the station where they are assembled to a second where the third part is inserted. If there is any relative motion of the first two parts, as the subassembly is moved from the first station to the second station, the third part cannot be inserted without breakage or human intervention. The problem has been solved in the prior art by the use of special components and/or close design tolerances. However, it is evident that the use of special components and close tolerances increase cost.

SUMMARY OF THE INVENTION

The present invention discloses a convenient and economical method for assembling a bobbin which has a coil wound thereon with a frame that comprises part of the magnetic circuit of the buzzer so that the bobbin and frame will retain a predetermined relationship as the subassembly is moved from one assembly station to the next to allow insertion of the magnetic core and other assembly operations.

In order to provide an effective and efficient magnetic circuit, the frame is fabricated with a bottom plane and a discontinuous parallel top plane with the top and bottom planes connected by parallel side surfaces. The separation between the top and bottom planes is designed to be slightly greater than the bobbin height so that the bobbin may be easily inserted between the bottom and top planes of the frame. By the time the bobbin is inserted to its desired location, an interference fit is provided for retaining the bobbin and the frame in a predetermined and fixed relative orientation. The retaining interference means may take any of a variety of forms. For example, the interference fit may be produced by a dimple appropriately located on either the bottom or top plane of the frame in order to provide a small pressure against the bobbin when it is inserted in the frame. As an alternative, the dimple may be molded into the bobbin which may be made of plastic material. If desired, the dimple may be placed on one element and a corresponding depression on the other element. In order to orient the bobbin, it is provided with a flange which has parallel sides that are spaced apart by a distance which is approximately equal to, but no greater than, the spacing between the parallel sides of the magnetic frame. Accordingly, as the bobbin is inserted in the frame, the bobbin is properly oriented. If desired, the bobbin could include an extension to prevent over insertion of the bobbin.

One bobbin flange includes two wells into which terminals may be inserted and to which the ends of the coil wound on the bobbin are connected. As is common in many buzzer structures, the frame constitutes part of the electrical circuit. In order to complete the electrical circuit with maximum economy and minimum parts, the bottom surface of the frame has an arch pressed therefrom such that as the bobbin is inserted into the frame, one of the terminals on the bobbin will mate with the arch to permit an electrical connection therebetween. This provides an alternate means for maintaining the relationship between the bobbin and frame. That is, the terminal and arch may provide an interference fit to prevent motion between the bobbin and frame.

It is an object of this invention to provide a new and improved buzzer structure which admits of convenient and economical automated assembly.

It is a more specific object of this invention to provide a means for retaining a desired orientation between a bobbin and frame subassembly as it is moved from one assembly station to another.

It is another object of this invention to provide a convenient, simple, and economical means for providing an electrical connection from one end of a coil wound on a bobbin to the frame.

It is another object of this invention to provide a retaining means which includes the electrical connection means between the coil and frame.

DESCRIPTION OF THE PREFERRED EMBODIMENT

In each of the views, a given element is always identified with the same three digit number. However, alternate structures are shown in some figures and, in these figures, selected elements will be given a four digit number wherein the first digit represents the figure number and the last three digits correspond to the number of the most closely corresponding element in other figures.

Figure 1:
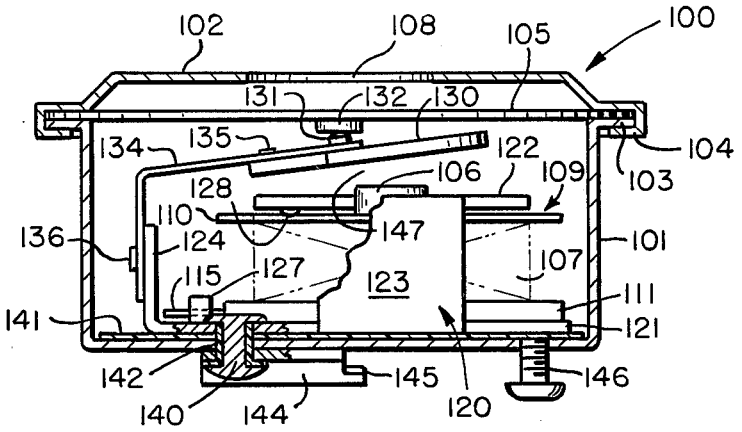
FIG. 1 comprises a cut away and partial cross-section view of the buzzer of the invention.

Attention is invited to FIG. 1 which shows the general details of a buzzer indicated generally as 100. The buzzer assembly 100 includes a cup-shaped lower housing 101 and a saucer-shaped cover 102. The lower housing 101 has a lip 103. The cover 102 may be joined to the lower housing 101 by crimping an edge 104 of the cover 102 over the lip 103. Clamped between the cover 102 and the lower housing 101 is a diaphragm 105 which, in this buzzer, acts as a sounding board or sound amplifier. The diaphragm 105 may be planar, as illustrated, or may include strengthening ribs. The cover 102 may include a sound transmitting hole 108. It desired, sound transmitting holes (not shown) could be included in the lower housing 101.

The buzzer will be activated to produce a sound by the buildup and decay of magnetic flux in a magnetic circuit, including a core 106, in response to an electric current in the coil 107 surrounding the core 106. The coil 107 is wound on a bobbin indicated generally as 109 and having an upper flange 110, and a lower flange 111, and a sleeve 112 (see also FIG. 3) surrounding the core 106. The bobbin 109 also includes sockets 113 and 114 into each of which a terminal 115 may be inserted. The lower flange 111 includes a slot 116 in which the lead wire to the inner end of the coil 107 may be placed for connection to the terminal 115. The bobbin 109 includes a hole 117 through which the core 106 is placed.

Figure 2T:
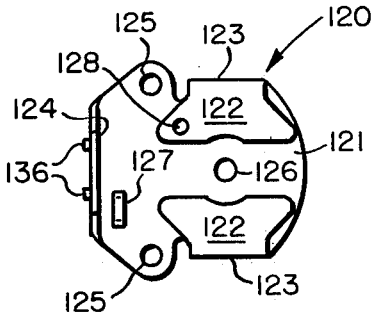
FIGS. 2T, 2S, and 2F comprise, respectively, a top, side, and front view of the magnetic frame.
Figure 2S:
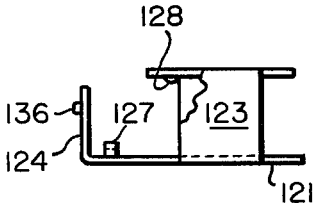
Figure 2F:
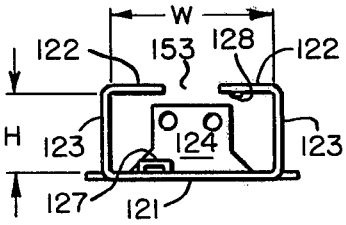
Figure 4:
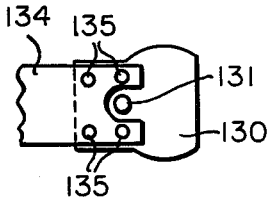
FIG. 4 is a top view of the armature and spring.

Within the buzzer 100, and included in the actuating magnetic circuit, is a magnetic frame indicated generally as 120 and shown more particularly in FIGS. 2T, 2S and 2F. As may be seen in these figures, the frame 120 comprises a generally planar bottom surface 121 and a generally parallel upper surface 122 with spaced apart portions. The bottom and upper surfaces 121 and 122 are coupled together by the sides 123. The frame 120 also includes a back member 124, mounting holes 125, and hole 126 through which the core 106 is staked. The frame 120 also includes an arch member 127 which will serve a function to be described more fully hereinafter. The buzzer 100 includes an armature member 130 shown in FIG. 4. Coupled to the armature 130 is a contact 121 which mates with another contact 132 on the diaphragm 105. The armature 130 is supported by an armature spring 134 with one end staked to the armature 130 by stakes 135 (some of which are not shown in FIG. 1 to avoid obscuring the contact 131). The other end of the armature spring 134 is staked to the frame back 124 by stakes 136. Other fastening means such as rivets could be used if desired.

The frame 120 and associated armature 130, bobbin 109 and coil 107 are fastened into the lower housing 101 by coupling means 140 which may comprise a rivet passing through the hole 125. It should be observed that insulator 141 electrically insulates the frame 120 from the lower housing 101; and the rivet, or coupling means 140, has an insulating sleeve 142 so that it does not make an electrical connection between the frame 120 and the lower housing 101. The coupling means 140 also attaches a mounting bracket 144 to the lower housing 101. A tang 145 is an integral part of the mounting bracket 144 and provides a simple means for connecting a wire thereto. The screw 146 is threaded into the lower housing 101 and, if turned inward, presses on the insulator 141 and pushes the frame 120 upward (as viewed in FIG. 1) to reduce the air gap 147 between the core 106 and the armature 130. if desired, an adjusting technique, as shown in FIG. 2 of the cited Berns U.S. Pat. No. 3,864,823, could be used.

Figure 10:
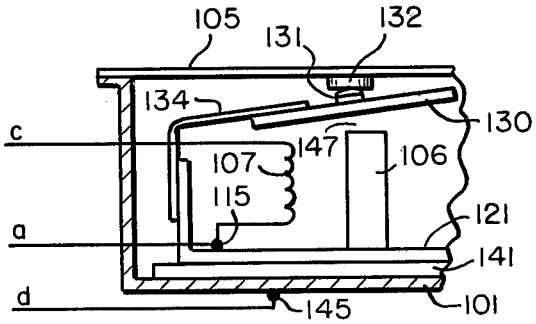
FIG. 10 is a wiring diagram illustrating how selected metallic portions of the assembly constitute a portion of the wiring.

Considering now more specifically FIG. 10, there will be seen therein a circuit diagram showing the components of the buzzer 100 which are included in the circuit. The coil 107 is schematically represented and the wire designated 'a' is the wire which would be coupled to terminal 115. The wire designated 'd' is coupled to the tang 145 and the wire designated 'c' is coupled to a terminal similar to terminal 115 inserted in socket 113. When a d.c. potential is applied across the wires designated 'd' and 'c', a current will flow from 'c' through the coil 107 to the frame surface 121, the armature spring 134, the armature 130, the armature contact 131, and the diaphragm contact 132 to the diaphragm 105 and the lower housing 101 to the tang 145 and the 'd' lead. In response to a flow of current as thus described, a magnetic flux will be generated which will pass through the magnetic core 106 and the magnetic frame 120 to attract the magnetic armature 130 to close the air gap 147. In response to this action, the contacts 131 and 132 will be separated to break the electrical circuit and cause a decay in the magnetic circuit, thereby releasing the armature 130 and causing the contacts 131 and 132 to reclose. This action will continue as long as a d.c. potential is applied to the leads 'd' and 'c' all in the manner which is conventional and well known to those familiar with buzzer assemblies. When a relatively low frequency a.c., or a half wave rectified a.c., is applied across the terminals 'a' and 'c', the coil 107 will be energized and a magnetic flux generated as before. For a half wave rectification, the magnetic flux will decay during alternate half cycles, thereby releasing the armature 130. If the a.c. frequency is low enough, the armature 130 may release as the current in the coil 107 passes through zero magnitude. This circuit is conventional and those familiar with such devices know how it works.

The vibration of the armature will vibrate the diaphragm 105 to amplify the sound.

From an examination of the parts comprising the frame 120, the bobbin 109, and the core 106, it will be evident that a natural sequence of assembly will include winding the coil 107 on the bobbin 109 and slipping the bobbin 109 into the preformed frame 120 with the lower flange 111 of the bobbin 109 in contact with the bottom surface 121 of the frame 120 until the hole 117 in the bobbin 109 is concentric with the hole 126 in the frame 120. Then the core 106 may be inserted into the hole 107 and a turned down portion (not shown) of the core 106 passed through the hole 126 and staked over on the bottom. The armature spring 134 and associated armature 130 will, thereafter, be coupled to the back 124 of the frame 120.

It will be evident that the reduced diameter portion of the core 106 which passes through the hole 126 will not mate therewith unless the hole 127 is very close to concentric with the hole 126. Accordingly, it is desirable to insert the bobbin 109 into the frame 120 to a predetermined orientation between the two elements and maintain that orientation until the core 106 is inserted and then, of course, the core serves to lock the bobbin 109 into the proper orientation with respect to the frame 120.

In an automated assembly procedure, the bobbin 109 may be inserted into the preformed frame 120 and then this subassembly moved to a subsequent assembly station for the insertion of the core 106. It will be evident that to achieve successful insertion of the bobbin 109 into the frame 120, the maximum height between the upper surface of the upper flange 110 and the lower surface of the lower flange 111 must not exceed the dimension between the lower surface of the upper surface 122 of the frame 130 and the upper surface of the bottom surface 121 of the frame. That is, the maximum height of the bobbin 109 must not exceed the dimension 'H' as shown in FIG. 2F. In fact, for automated assembly, the height of the bobbin must be slightly less than the dimension 'H' shown in FIG. 2F. Therefore, if the bobbin is inserted to the desired orientation with respect to the frame 120, some provision must be made to retain that orientation while the subassembly of the bobbin and frame are moved to the next assembly station for insertion of the core 106. Various techniques are disclosed for maintaining the desired orientation.

Figure 5A:
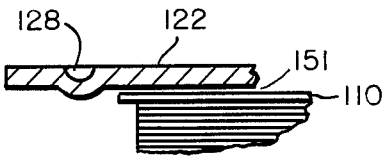
FIGS. 5A and 5B, 6A and 6B, 7A and 7B disclose alternate means for providing an interference fit between the bobbin and frame.

Considering now more specifically FIG. 5A, there is seen therein an enlarged fragmentary view of the upper frame surface 122 and the upper flange 110 as the bobbin 109 is being inserted into the frame 120. There is a clearance 151 between the upper flange 110 and the upper frame surface 122. It should also be observed that the upper frame surface 122 includes a dimple 128 which is also shown in FIGS. 1, 2T, 2S, and 2F. Continued insertion of the bobbin will result in the upper flange 110 coming in contact with the dimple 128 to produce an interference fit which will result in a slight flexure of the upper frame surface 122 and create a pressure between the dimple 128 and the upper flange 110. The described relationship between the dimple 128 and the upper flange 110 will retain the the required orientation between the bobbin 109 and the frame 120.

Figure 3:
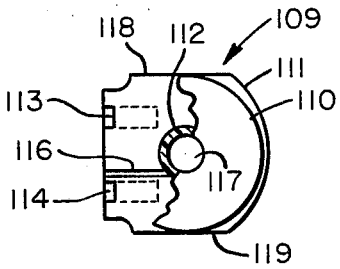
FIG. 3 comprises a cut away and partial cross-section view of the bobbin.

As may be seen in FIG. 3, the bobbin 109 includes a lower flange 111 having parallel sides 118 and 119. The upper flange 110 could take the same shape or could be circular in form as long as the diameter of the upper flange 110 does not exceed the spacing between the parallel sides 118 and 119 of the lower flange 111. The spacing between the inner surfaces of the sides 123 of the frame 120 may be a distance 'W' as illustrated in FIG. 2F. The spacing between the parallel edges 118 and 119 of the lower flange 111 must not exceed the dimension 'W'. The parallel edges 118 and 119 on the bobbin 109 guide the bobbin into the frame 120 and provide an orientation, with respect to the frame, serving a purpose to be described more fully hereinafter. Although the edges 118 and 119 have thus far been described as being parallel, it will be evident that the leading edges thereof may be bowed slightly inward to help facilitate and guide the insertion of the bobbin into the frame.

Figure 5B:
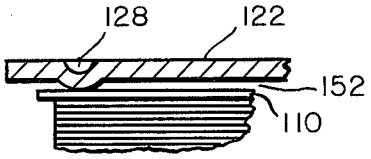

Returning to FIGS. 5A and 5B, it will be observed that after the bobbin 109 is inserted into the frame 120, the clearance 152 between the bobbin and the frame is slightly greater than the clearance 151. This results from the interference between the dimple 128 and the flange 110 which results in minor upward displacement of the upper frame surface 122.

Figure 6A:
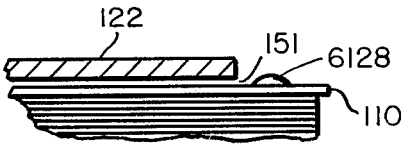
Figure 6B:
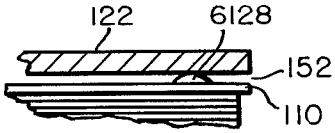

An alternate method of retaining an orientation between the bobbin 109 and the frame 120 is illustrated in FIGS. 6A and 6B, wherein a dimple 6128 is formed on the flange 110 instead of on the upper frame surface 122. The dimple 6128 provides an interference fit and maintains a desired orientation between the bobbin 109 and the frame 120. The dimple 6128 could easily and economically be molded into the bobbin 109. The dimple 128 could easily and economically be pressed into the frame 120 during a part of the stamping operation.

Figure 7A:
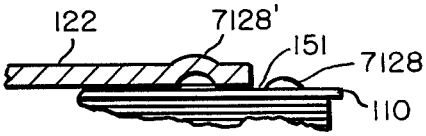
Figure 7B:
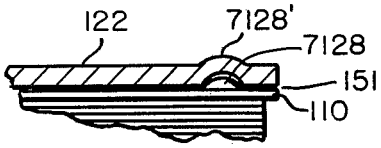

Another alternate arrangement is shown in FIGS. 7A and 7B, wherein a dimple 7128 is formed on the upper flange 110 and a mating reversed curvature dimple 7128' is formed on the upper frame surface 122. The structure of FIGS. 7A and 7B does have the disadvantage that accurate placement of the dimple 7128 and the reversed dimple 7128' is required to assure that when they are in mating relationship the holes 117 of the bobbin 109 and 126 of the frame 120 are concentric.

The shape of the bobbin 109 and the edges 118 and 119, which mate with the sides 123 of the frame 120, provide an orientation of the bobbin, such that if the structures of FIGS. 6 or 7 are used, there is an assurance that the dimple 6128 or 7128, as the case may be, will be oriented under the upper frame surface 122 and not within the gap 153 separating the two portions of the upper surface 122.

Figure 8:
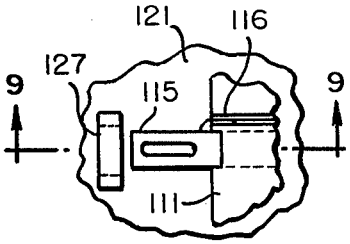
FIG. 8 is an enlarged fragmentary view showing the terminal on the bobbin entering the arch on the frame.
Figure 9:
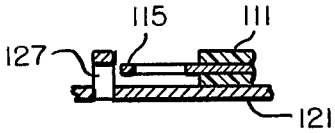
FIG. 9 is a cross-section view of FIG. 8 taken on the line 9—9.

Considering now more specifically FIGS. 8 and 9, there will be seen a fragmentary enlarged view of a portion of the bobbin 109 and, more particularly, of the socket 114 and the terminal 115 inserted therein, together with the arch 127 formed on the frame 120. It will be recalled that the edges 118 and 119 of the lower flange 111 guide and orient the bobbin 109 as it is inserted into the frame 120. Another reason for providing this guide and orientation is to assure that the terminal 115 will be aligned with the arch 127 for insertion therethrough as the terminal 115 approaches the arch 127 (see FIG. 9). If desired, the terminal 115 and the arch 127, in cooperation, could provide the interference fit means in place of any of the techniques disclosed in FIGS. 5, 6, and 7. For example, the terminal 115 could be formed with a downward leading edge to facilitate entry into the arch 127 and then the remainder of the terminal 115 could press against the upper edge of the arch 127 and provide the retaining means to retain the bobbin 109 in a fixed predetermined orientation with respect to the frame 120. At this stage of assembly, or at some other stage of assembly, a drop of solder may be placed on the terminal 115 and the arch 127 to provide an electrical contact therebetween. This provides the electrical connection as shown in FIG. 10.

In summary, there has been shown a convenient and economical means for assembling a buzzer coil into its magnetic frame and providing a means for retaining a required placement and orientation of the bobbin with respect to the frame as that subassembly is moved to a subsequent assembly station.

While there has been shown and described what is considered at the present to be a preferred embodiment of the invention, modifications thereto will readily occur to those skilled in the related arts. For example, the dimple means could be provided on the lower flange of the bobbin or frame. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. An improved buzzer structure designed for automated assembly and comprising in combination:
   (a) a bobbin assembly having a coil wound thereon and having parallel flanges spaced a predetermined distance apart for retaining said coil;
   (b) a magnetic frame having parallel surfaces separted by an amount slightly in excess of said predetermined distance for accommodating bobbin insertion; and
   (c) interference means between said bobbin assembly and said parallel frame surfaces, effective after partial insertion of said bobbin, for retaining said bobbin assembly and said frame in a predetermined relative orientation.

2. The combination as set forth in claim 1, wherein said interference means comprises a dimple on one of said parallel frame surfaces and said bobbin flanges.

3. The combination as set forth in claim 2 and including a depression on the other of said frame and said bobbin for mating with said dimple when said bobbin is inserted into said frame sufficiently to achieve said predetermined relationship.

4. The combination as set forth in claim 1 and including:
   (a) parallel side walls of said frame; and
   (b) said bobbin including one flange with parallel edges for mating with the parallel side walls of said frame and for guiding and orienting said bobbin as it is inserted in said frame.

5. The combination as set forth in claim 1 and including:
   (a) a terminal affixed to said bobbin assembly for connecting to one end of the coil wound on said bobbin assembly;
   (b) an arch formed on said frame into which said terminal is inserted when said bobbin assembly and said frame are in said predetermined orientation.

6. The combination as set forth in claim 5, wherein said interference means comprises a dimple on one of said frame and said bobbin.

7. The combination as set forth in claim 6 and including a depression on the other of said frame and said bobbin for mating with said dimple when said bobbin is inserted into said frame sufficiently to achieve said predetermined relationship.

8. The combination as set forth in claim 5, wherein said interference means comprises an interference fit between said terminal and said arch.

9. The combination as set forth in claim 5, wherein said frame includes parallel side walls joining said parallel surfaces and said bobbin assembly includes one flange with parallel edges for mating with said parallel side walls of said frame for guiding and orienting said bobbin as it is inserted in said frame.

10. A buzzer structure comprising in combination:
   (a) a bobbin assembly having first and second flanges for limiting the displacement of a coil winding placed thereon;
   (b) a socket in said first flange of said bobbin assembly for accommodating and retaining a terminal inserted therein and extending in the plane of said first flange;
   (c) said coil wound on said bobbin having one end thereof coupled to said terminal for making an electrical connection therebetween; and
   (d) a magnetic frame for accommodating said bobbin assembly and including an arch formed on said frame for mating with said terminal when said bobbin assembly is assembled with said frame whereby an electrical connection may be completed from said coil to said frame.

11. The combination as set forth in claim 10 and including interference means between said bobbin assembly and said frame for retaining said bobbin assembly and said frame in a predetermined relative orientation.

12. The combination as set forth in claim 11, wherein said interference means comprises contact between said terminal and said arch.

13. The combination as set forth in claim 11, wherein
   (a) said first and second flanges of said bobbin assembly are separated by a predetermined amount; and
   (b) said frame includes parallel surfaces separated by an amount slightly in excess of said predetermined amount for accommodating bobbin assembly insertion.

14. The combination as set forth in claim 13, wherein said interference means comprises a dimple on one of said parallel frame surfaces and said bobbin assembly flanges.

15. The combination as set forth in claim 14 and including a depression on the other of said parallel frame surfaces and said bobbin assembly flange for mating with said dimple when said bobbin assembly is inserted into said frame sufficiently to achieve said predetermined relationship.

16. The combination as set forth in claim 10 and including :
   (a) parallel side walls of said frame; and
   (b) said bobbin assembly including one flange with parallel edges for mating with said parallel side walls for guiding and orienting said bobbin assembly as it is inserted in said frame.

* * * * *